US008191378B2

(12) United States Patent
Park

(10) Patent No.: US 8,191,378 B2
(45) Date of Patent: Jun. 5, 2012

(54) DISPENSER RELATED TECHNOLOGY

(75) Inventor: Joo-Won Park, Busan (KR)

(73) Assignee: LG Electronics Inc., Seoul (KR)

( * ) Notice: Subject to any disclaimer, the term of this patent is extended or adjusted under 35 U.S.C. 154(b) by 761 days.

(21) Appl. No.: 12/399,097

(22) Filed: Mar. 6, 2009

(65) Prior Publication Data

US 2009/0249816 A1 Oct. 8, 2009

(30) Foreign Application Priority Data

Apr. 7, 2008 (KR) ..... 10-2008-0032361

(51) Int. Cl.
*F25C 1/22* (2006.01)

(52) U.S. Cl. ..... 62/340

(58) Field of Classification Search ..... 62/340, 62/440

See application file for complete search history.

(56) References Cited

U.S. PATENT DOCUMENTS 4,209,999 A * 7/1980 Falk et al. ..... 62/344
4,227,383 A * 10/1980 Horvay ..... 62/344
7,316,121 B2 1/2008 Lee et al.
7,383,689 B2 6/2008 Lee et al.
7,628,032 B2 * 12/2009 Lee et al. ..... 62/344
2006/0201194 A1 9/2006 Bowen et al.

FOREIGN PATENT DOCUMENTS

KR 2004085744 A 10/2004
KR 20050028630 3/2005
KR 510698 B1 8/2005
KR 2006106350 A 10/2006
KR 2009040948 A 4/2009

OTHER PUBLICATIONS

Korean Office Action issued in Korean Patent Application No. 10-2008-0032361, mailed Dec. 7, 2009, 4 pages.
Korean Notice of Allowance issued in Application No. 10-2008-0032361, mailed Mar. 18, 2010, 2 pages.

* cited by examiner

*Primary Examiner* — Melvin Jones
(74) *Attorney, Agent, or Firm* — Fish & Richardson P.C.

(57) ABSTRACT

A refrigerator, in which a dispensing unit moves between a received position and a dispensing position, and a dispenser receiving structure defines a receiving space in which at least a portion of the dispenser unit is positioned when the dispensing unit is oriented in the received position. The refrigerator also includes a cover unit that is attached to the dispensing unit and moves with the dispensing unit. The cover unit covers a portion of an opening defined in a surface of a door by the dispenser receiving structure when the dispensing unit is oriented in the received position. The refrigerator further includes a shielding unit that covers a gap remaining between the dispenser receiving structure and the cover unit when the dispensing unit is oriented in the received position.

20 Claims, 10 Drawing Sheets

DISPENSER RELATED TECHNOLOGY

CROSS REFERENCE TO RELATED APPLICATIONS

This application claims the benefit of Korean Patent Application No. 10-2008-0032361, filed on Apr. 7, 2008, which is hereby incorporated by reference for all purposes as if fully set forth herein.

FIELD

The present disclosure relates to refrigerator and/or dispenser technology.

BACKGROUND

In general, a refrigerator is a device that preserves items, such as food or beverages, in storage in a cool or frozen state by using cool air generated by a refrigerating cycle. A refrigerator may include an ice maker configured to make ice and a dispenser configured to dispense liquid water and ice made by the ice maker.

SUMMARY

In one aspect, a refrigerator having a dispenser includes a cooling compartment and a door configured to open and close at least a portion of the cooling compartment. The refrigerator also includes a dispensing unit that is configured to move between a received position at which a dispenser outlet of the dispensing unit is positioned on a side of a surface of the door where the cooling compartment is positioned and a dispensing position at which the dispenser outlet of the dispensing unit is positioned on a side of the surface of the door opposite of the cooling compartment, and a dispenser receiving structure that defines, within the door, a receiving space in which the dispenser outlet is positioned when the dispensing unit is oriented in the received position and that defines, in the surface of the door, an opening through which the dispenser outlet of the dispensing unit passes when the dispensing unit moves from the dispensing position to the received position. The refrigerator further includes a cover unit that is attached to the dispensing unit and moves with the dispensing unit. The cover unit and the dispensing unit are coupled to enable a portion of the opening defined in the surface of the door by the dispenser receiving structure to be covered by the cover unit when the dispensing unit is oriented in the received position, and to enable a gap to remain on the surface of the door between the cover unit and the dispenser receiving structure when the dispensing unit is oriented in the received position. The refrigerator includes a shielding unit configured to cover the gap remaining between the dispenser receiving structure and the cover unit when the dispensing unit is oriented in the received position.

Implementations may include one or more of the following features. For example, the cover unit may be configured to rotate about an axis of rotation that is above the cover unit when the refrigerator is oriented in a normal operating orientation. The cover unit also may be configured to rotate, about the axis of rotation that is above the cover unit, from the surface of the door without any part of the cover unit rotating into the space defined by the dispenser receiving structure. The cover unit further may be configured to rotate, about the axis of rotation that is above the cover unit, from the surface of the door without any part of the cover unit passing through the opening defined in the surface of the door by the dispenser receiving structure, and the cover unit may be configured to rotate, about the axis of rotation that is above the cover unit, from the surface of the door while maintaining a consistent separation distance between an edge of the cover unit and an edge of the dispenser receiving structure that defines the opening in the surface of the door.

In addition, the gap covered by the shielding unit may be a portion of the opening not covered by the cover unit when the dispensing unit is oriented in the received position and the cover unit may cover the portion of the opening defined in the surface of the door by the dispenser receiving structure. The cover unit may be positioned in a plane of the surface of the door when the dispensing unit is oriented in the received position.

In some implementations, the shielding unit may be positioned, in the space defined by the dispenser receiving structure, around a portion of a surface perimeter of the dispenser receiving structure that defines the opening, with the shielding unit overlapping a portion of an outer perimeter of the cover unit when the dispensing unit is oriented in the received position. In these implementations, the refrigerator may include a hermetically sealing member that is made of an elastic material, that overlaps with the cover unit when the dispensing unit is oriented in the received position, and that is attached to one of the shielding unit and the cover unit. The shielding unit may be positioned around an entire perimeter of the dispenser receiving structure that defines the opening, with the shielding unit overlapping with an entire outer perimeter of the cover unit when the dispensing unit is oriented in the received position and the opening is completely covered by the cover unit and the shielding unit.

In some examples, the dispensing unit may include a guide unit that is attached to a surface of the cover unit positioned closest to the cooling compartment, that defines the dispenser outlet, and that is configured to guide ice through the dispenser outlet when the dispensing unit is oriented in the dispensing position, and a dispensing button unit that is configured to move, along with the cover unit, between a stored position at which the dispensing button unit is positioned on the side of the surface of the door where the cooling compartment is positioned and an extended position at which at least a portion of the dispensing button unit is positioned on the side of the surface of the door opposite of the cooling compartment. The dispensing button unit may be configured to, in the extended position, control dispensing of content through the dispenser outlet in response to manipulation of the dispensing button unit. The dispensing unit also may include a driving unit that is configured to move the dispensing unit from the received position to the dispensing position in response to user input and that is configured to move the dispensing button unit from the stored position to the extended position in response to user input.

In these examples, the dispensing button unit may include a button frame unit that is positioned below the guide unit when the refrigerator is oriented in a normal operating orientation and that is configured to move between the stored position at which the button frame unit is positioned on the side of the surface of the door where the cooling compartment is positioned and the extended position at which at least a portion of the button frame unit is positioned on the side of the surface of the door opposite of the cooling compartment, and a button unit that is elastically supported by the button frame unit and that is configured to, when the button frame unit is oriented in the extended position, move, in response to application of force to the button unit, toward the surface of the door from a first position to a second position that is closer to the surface of the door than the first position and move, in response to release of the force applied to the button unit, away from the surface of the door from the second position to the first position. The button unit may be configured to cause the dispensing unit to dispense content through the dispenser outlet when the button unit is moved to the second position.

Further, the driving unit may include a driving gear configured to be driven by a motor, a first following gear engaged with the driving gear and configured to rotate the dispensing unit from the received position to the dispensing position in response to the driving gear being driven by the motor, and a second following gear engaged with the driving gear and configured to move the dispensing button unit from the stored position to the extended position in response to the driving gear being driven by the motor. The first following gear may have a circular arc shape with a central angle of less than 360 degrees being defined between radial axes extending from a rotation axis of the arc and endpoints of the first following gear periphery. A first end of the first following gear may be connected at the rotation axis, a second end of the first following gear may be connected with the dispensing unit, and the first following gear may be configured to rotate about the rotation axis in response to the driving gear being driven by the motor. The second following gear may include a sliding unit that extends in a radial direction and comprises a sliding slot configured to receive a sliding protrusion positioned at a side of the dispensing button unit. The sliding unit may be configured to move the dispensing button unit by applying force to the sliding protrusion when the sliding protrusion is received in the sliding slot.

In another aspect, a refrigerator includes a cooling compartment and a door configured to open and close at least a portion of the cooling compartment. The refrigerator also includes a dispensing unit that is configured to move between a received position at which a dispenser outlet of the dispensing unit is positioned on a side of a surface of the door where the cooling compartment is positioned and a dispensing position at which the dispenser outlet of the dispensing unit is positioned on a side of the surface of the door opposite of the cooling compartment, and a dispenser receiving structure that defines, within the door, a receiving space in which the dispenser outlet is positioned when the dispensing unit is oriented in the received position and that defines, in the surface of the door, an opening through which the dispenser outlet of the dispensing unit passes when the dispensing unit moves from the dispensing position to the received position. The refrigerator further includes a cover unit that is attached to the dispensing unit and that moves with the dispensing unit and a hinge defining an axis of rotation that is above the cover unit when the refrigerator is oriented in a normal operating orientation. The cover unit may be configured to cover a portion of the opening defined in the surface of the door by the dispenser receiving structure when the dispensing unit is oriented in the received position.

Implementations may include one or more of the following features. For example, the cover unit may be configured to rotate, about the axis of rotation that is above the cover unit, from the surface of the door without any part of the cover unit rotating into the space defined by the dispenser receiving structure. The cover unit also may be configured to rotate, about the axis of rotation that is above the cover unit, from the surface of the door without any part of the cover unit passing through the opening defined in the surface of the door by the dispenser receiving structure. The cover unit further may be configured to rotate, about the axis of rotation that is above the cover unit, from the surface of the door while maintaining a consistent separation distance between an edge of the cover unit and an edge of the dispenser receiving structure that defines the opening in the surface of the door.

DETAILED DESCRIPTION

Figure 1:
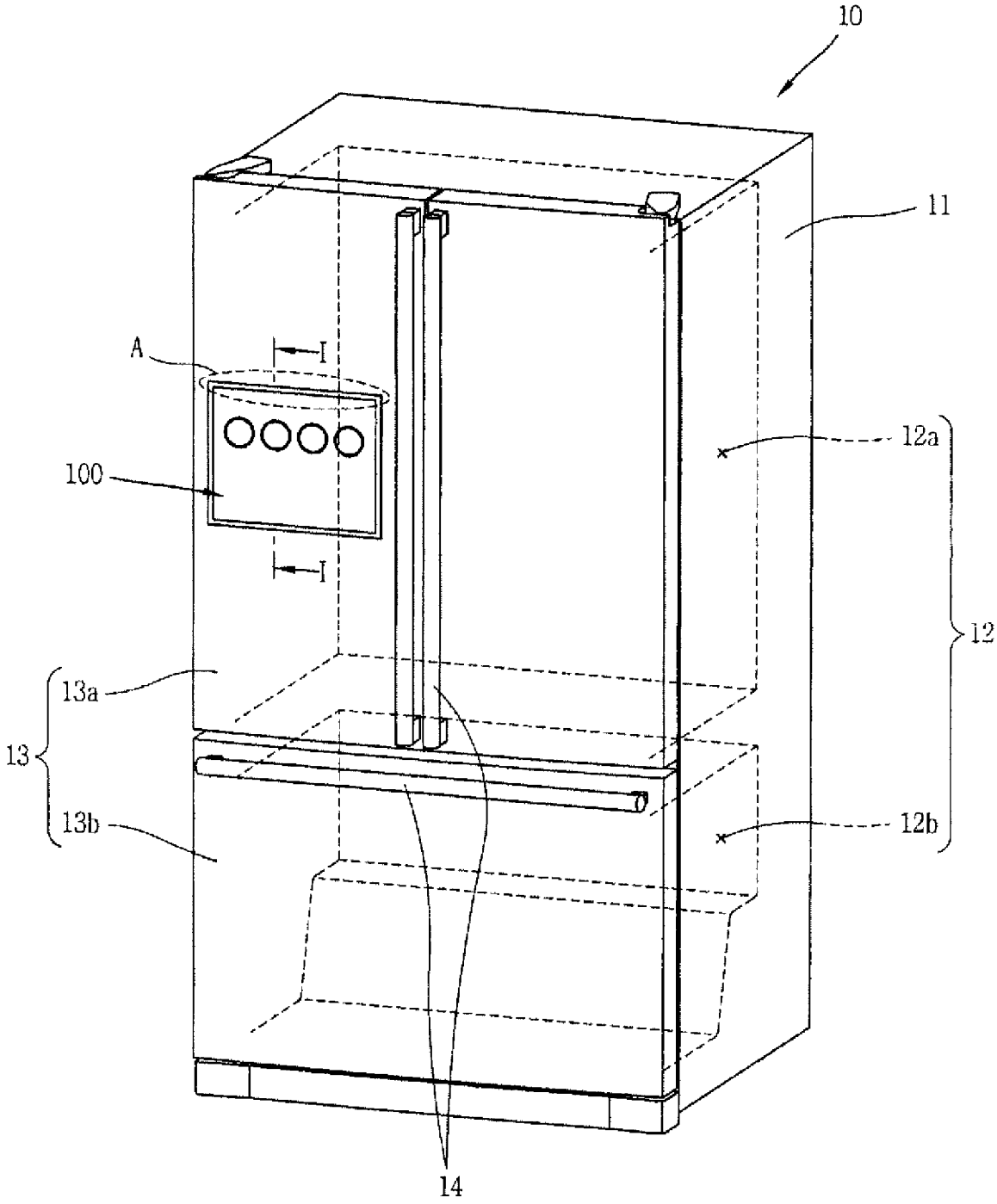
FIG. 1 is a view showing a refrigerator.
Figure 2:
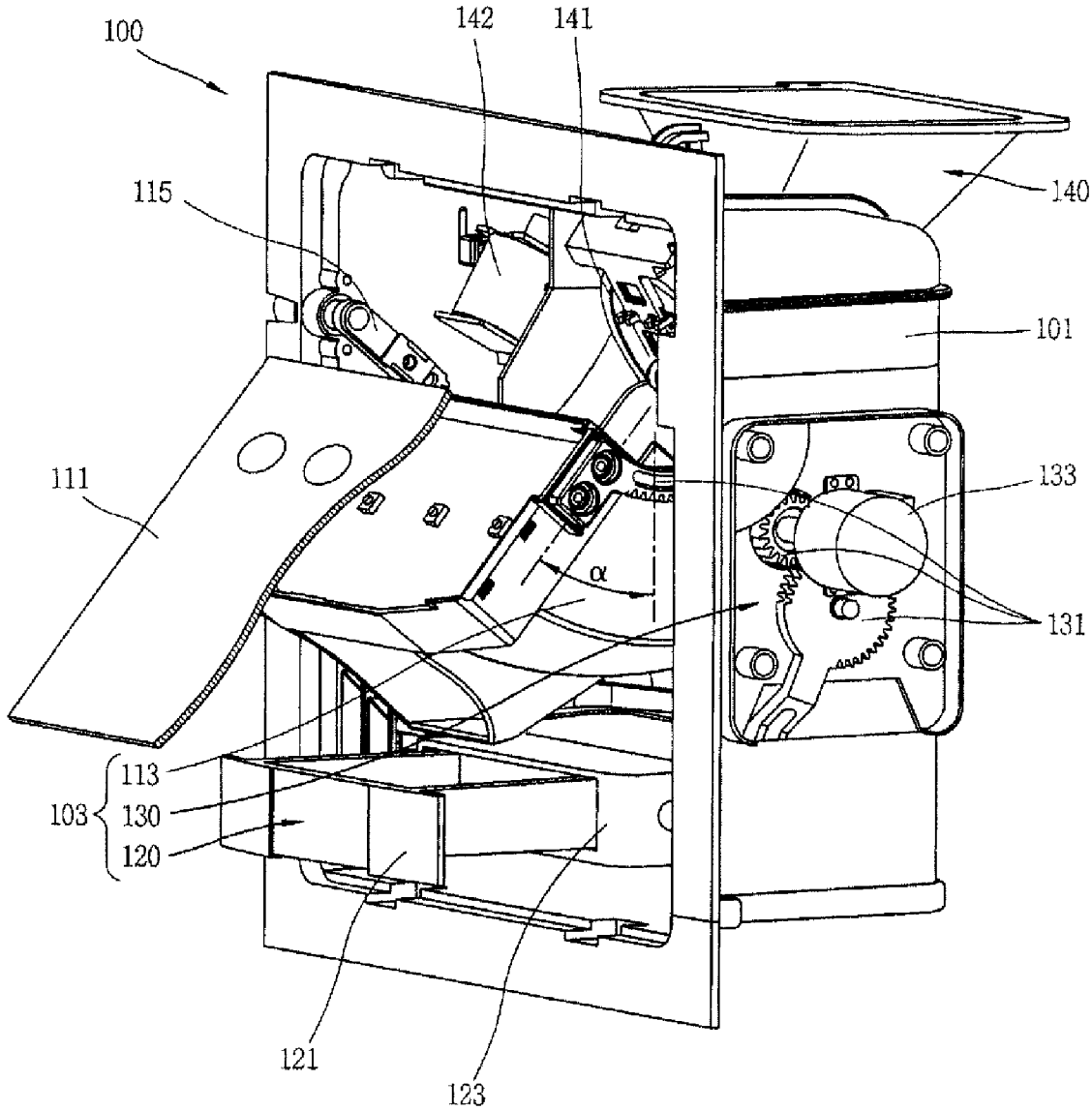
FIG. 2 is a perspective view showing an internal structure of the dispenser in FIG. 1.
Figure 3:
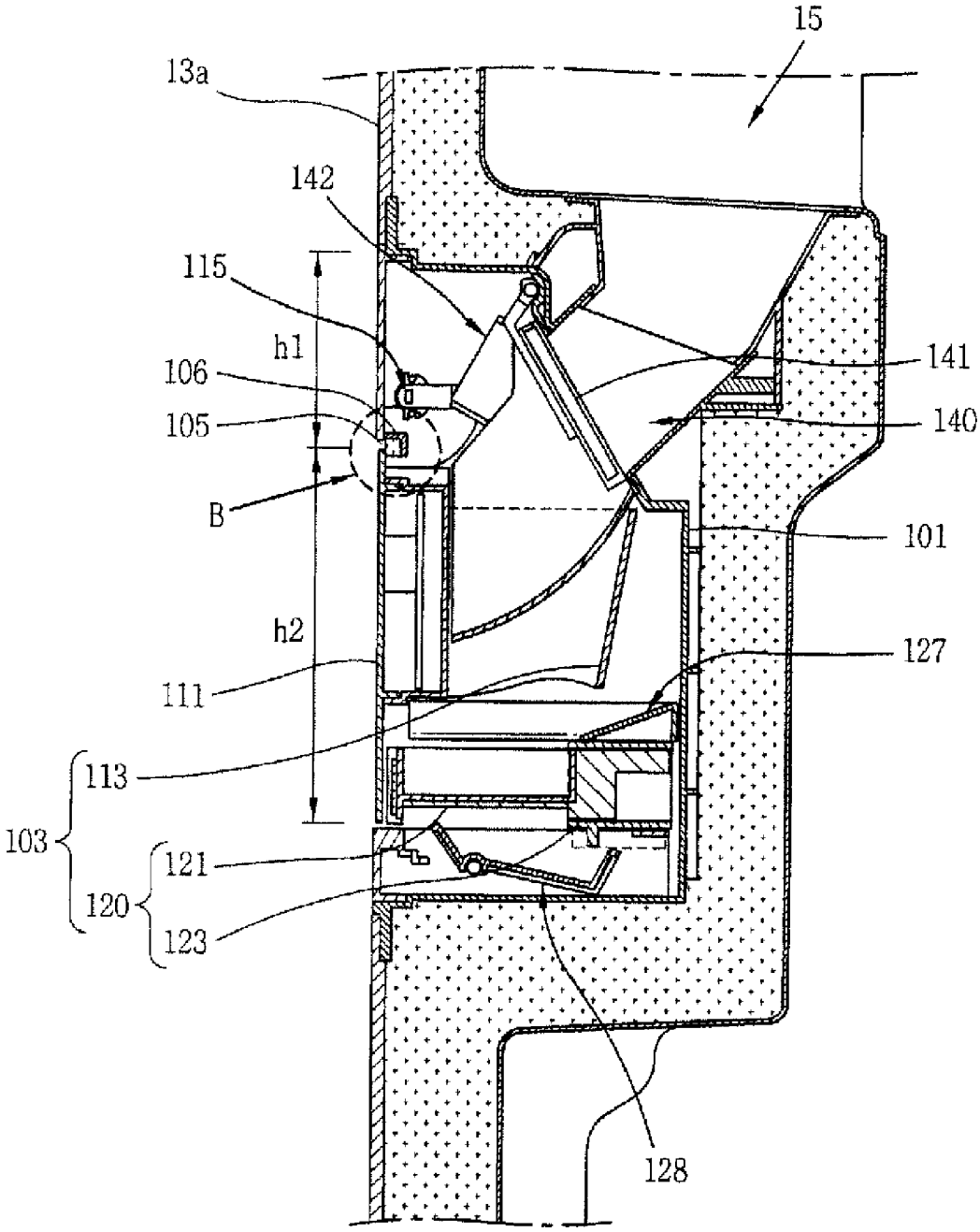
FIG. 3 is a sectional view taken along line I-I in FIG. 1.

FIG. 1 illustrates a refrigerator having a dispenser, FIG. 2 shows an internal structure of the dispenser in FIG. 1, and FIG. 3 illustrates a sectional view of the dispenser taken along line I-I in FIG. 1.

With reference to FIGS. 1 to 3, a refrigerator 10 includes a cooling chamber 12 that stores storage items and a door 13 that shields the cooling chamber from the exterior.

The cooling chamber 12 is positioned within a main body 11 that defines an external appearance of the refrigerator 10. A gap exists between an inner surface of the cooling chamber 12 and an outer surface of the main body 11, and a heat insulator is positioned within the gap.

The interior of the cooling chamber 12 is insulated from the exterior of the main body 11 by the heat insulator.

Also, one side of the cooling chamber 12 is exposed (e.g., vacant, opened, etc.) to allow items to be put in or taken out, and such one side is covered by a door 13 that is connected to the main body 11 by hinges that enable opening and closing of the door 13.

Because a heat insulator is inserted in the door 13, heat transfer to the cooling chamber 12 via the door 13 can be reduced.

A door handle 14 may be coupled to a portion of a front surface of the door 13 to allow a user to grasp it, and use the door handle 14 to open and close the door 13.

A refrigerating cycle (not shown) for generating cooling air to cool the cooling chamber 12 is provided at one side of the main body 11.

Several mechanisms exist for the construction and operation of the refrigerating cycle, and, therefore, a detailed description on the refrigerating cycle will be omitted. Any of mechanism may be used for the refrigerating cycle of the refrigerator 10.

The cooling air generated by the refrigerating cycle may be supplied to the cooling chamber 12 via a cooling air supply duct (not shown) formed within the main body 11 to cool the interior of the cooling chamber 12.

Of course, an air blower (not shown) may be provided to smoothly supply cooling air through the cooling air supply duct.

The cooling chamber 12 may include a refrigerating chamber 12*a* that freshly keeps storage items in storage without freezing them and a freezing chamber 12*b* that keeps storage items in a frozen state in storage for a long period.

Also, the refrigerating chamber 12*a* and the freezing chamber 12*b* may have various types of specific configurations (or structures) such that consumers may select the configuration they desire based upon how they use their refrigerator or based upon the types or amount of things (food) to be stored therein.

FIG. 1 shows an example of the refrigerator 10 in an ordinary operating orientation. For instance, as shown, when a support structure of the refrigerator 10 rests against the ground, the refrigerating chamber 12*a* is positioned at a relatively upper portion of the main body 11 and the freezing chamber 12*b* is positioned at a relatively lower portion of the main body 11. The ordinary operating orientation may reflect the intended orientation of the refrigerator 10 when being used by a consumer.

In some implementations, as shown in FIG. 1, because users typically access the refrigerating chamber 12*a* more than the freezing chamber 12*b*, the refrigerating chamber 12*a* may be provided at an upper portion and the freezing chamber 12*b* may be provided at a lower portion such that user convenience is improved. Also, a freezing chamber door 13*b* for opening and closing the freezing chamber 12*b* may be a pull-out drawer assembly (instead of a hinged assembly used in the refrigerating chamber door 13*a*) such that the user can place items into or remove items from the freezing chamber 12*b* more easily without having to strenuously bend down (or lower his posture) to access the freezing chamber 12*b*.

Alternatively, the freezing chamber 12*b* may be formed at the upper portion and the refrigerating chamber 12*a* may be formed at the lower portion. Of course, the refrigerating chamber 12*a* and the freezing chamber 12*b* may be horizontally oriented and positioned side by side.

A dispenser 100 is provided on the refrigerator 10 to dispense ice or the like made in the cooling chamber 12 from the exterior without opening the door 13.

FIG. 1 shows an example in which the dispenser 100 is provided on the refrigerating door 13*a*, but alternatively, the dispenser 100 may be provided on the freezing chamber door 13*b*.

With reference to FIGS. 2 and 3, an ice making unit 15 may be provided within the cooling chamber 12 to make ice or the like to be dispensed via the dispenser 100, and the ice making unit 15 and the dispenser 100 may be installed to be connected with each other.

For this, the ice making unit 15 and the dispenser 100 are connected with each other, and a transfer unit 140 may be provided to transfer ice or the like made by the ice making unit 15.

The ice making unit 15 may be provided within the cooling chamber 12 or on the rear surface of the door 13, namely, the surface facing the cooling chamber 12.

The construction and the operation of the ice making unit 15 may be the same as those of known ice making units, so its detailed description will be omitted.

In the present exemplary embodiment, the dispenser 100 includes a dispenser receiving part 101 positioned on the door 13, a dispensing unit 103 received in the dispenser receiving part 101 in a received position and ejected from the dispenser receiving part 101 in a dispensing position, and a cover unit 111 that covers the dispenser receiving part 101 when the dispensing unit 103 is in the received position.

The dispenser 100 further includes a shielding unit 106 that shields a gap 105 (see FIG. 4) that exists between the dispenser receiving part 101 and the cover unit 111.

The dispenser receiving part 101 is positioned at a recessed portion of the door 13. The dispenser receiving part 101 may include an opening on the front surface of the door 13.

In this example, the opening may have the same size as the recessed area of the dispenser receiving part 101, and in this case, the overall area of the opening may be sufficient to accommodate a dispensing unit 103 (described hereafter) that will be opened or closed, while reducing any detrimental effects to the external appearance (aesthetics) of the dispenser 100. Thus, the area of the opening may be smaller than the recessed portion of the dispenser receiving part 101.

The dispensing unit 103 is positioned in the dispenser receiving part 101 such that it is received into an interior of the opening of the dispenser receiving part 101 when the dispensing unit 103 is in the received position and ejected in front of the door 13 via the opening when the dispensing unit 103 is moved from the received position to the dispensing position.

When the dispensing unit 103 is moved from the dispensing position to the received position, the dispensing unit 103 is received in the interior through the opening of the dispenser receiving part 101, and housed in the interior of the dispenser receiving part 101 such that it may be ejected forwardly from the door 13 through the opening.

The dispensing unit 103 includes a guide unit 113 that guides dispensing of ice or the like, a dispensing button unit 120 that initiates dispensing of ice or the like, and a driving unit 130 that drives the receiving and ejecting operations of the guide unit 113 and the dispensing button unit 120. The construction is described in more detail below.

The cover unit 111 is attached to the front surface of the guide unit 113 and ejected together with the dispensing unit 103 when the dispensing unit 103 is ejected, and covers the opening of the dispenser receiving part 101 when the dispensing unit 103 is received.

In some examples, a certain gap 105 exists between an upper end of the opening of the dispenser receiving part 101 and at an upper end of the cover unit. The gap 105 may be needed to prevent the upper end of the opening of the dispenser receiving part 101 and the upper end of the cover unit 111 from contacting when the dispensing unit 103 is ejected.

In these examples, however, because the gap 105 exists, if the dispensing unit 103 is retracted (closed), a portion of the dispensing unit 103 may be undesirably seen through the gap 105, which may detrimentally impact the external appearance (aesthetics) of the dispenser 100.

In order to reduce the detrimental impact on the external appearance (aesthetics) of the dispenser 100, the shielding unit 106 is provided at the upper end of the opening of the dispenser receiving part 101.

The transfer unit 140 may be provided at an upper side of the dispenser receiving part 101, allowing an outer side and an inner side of the dispenser receiving part 101 to communicate with each other.

An opening/closing member 141 for selectively opening the transfer unit 140 when ice or the like needs to be transferred via the transfer unit 140 may be provided at an inner side of the transfer unit 140. One side of the opening/closing member 141 may be hinge-connected with the transfer unit 140 or with the dispenser receiving part 101 and may be rotated by a driving unit such as a solenoid 142.

Figure 4:
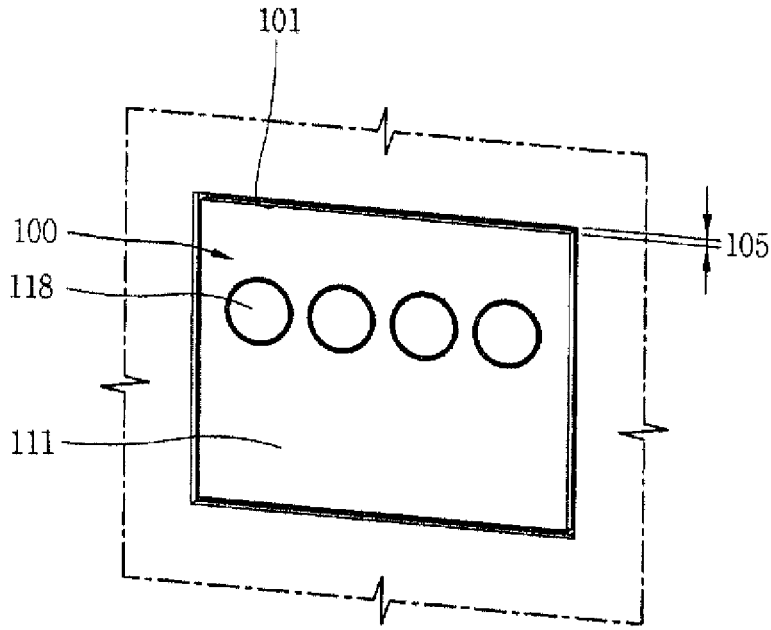
FIG. 4 is an enlarged view of a portion 'A' in FIG. 1.
Figure 5:
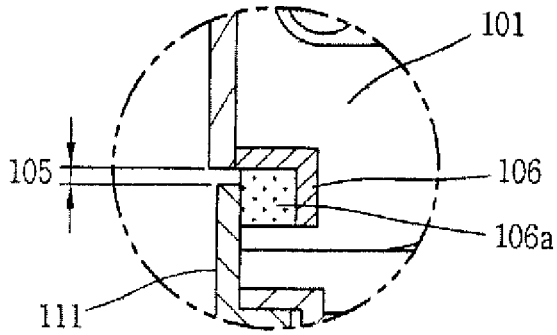
FIG. 5 is an enlarged perspective view of a portion 'B' in FIG. 3.

FIG. 4 is an enlarged view of a portion 'A' in FIG. 1, and FIG. 5 is an enlarged perspective view of a portion 'B' in FIG. 3.

With reference to FIGS. 4 and 5, the shielding unit 106 is positioned at the upper end of the opening of the dispenser receiving part 101.

In detail, the shielding unit 106 extends downwardly from the upper end of the opening of the dispenser receiving part 101 and covers the gap 105 (e.g., prevents an upper portion of the dispensing unit 103 from being shown through the gap 105) that exists between the upper end of the opening and the upper end of the cover unit 111.

In some implementations, a hermetically sealing member 106*a* is provided between the shielding unit 106 and a corresponding upper end portion of the rear surface of the cover unit 111. The hermetically sealing member 106 may reduce leakage of cooling air from the interior of the cooling chamber 12 to the exterior via the dispenser 100.

In addition, generation of noise, which may be caused by collision between the cover unit 111 and the shielding unit 106 when the cover unit 111 is received, may be reduced.

The hermetically sealing member 106*a* may be fixed to either the shielding unit 106 or the corresponding upper end portion of the rear surface of the cover unit 111.

Figure 6:
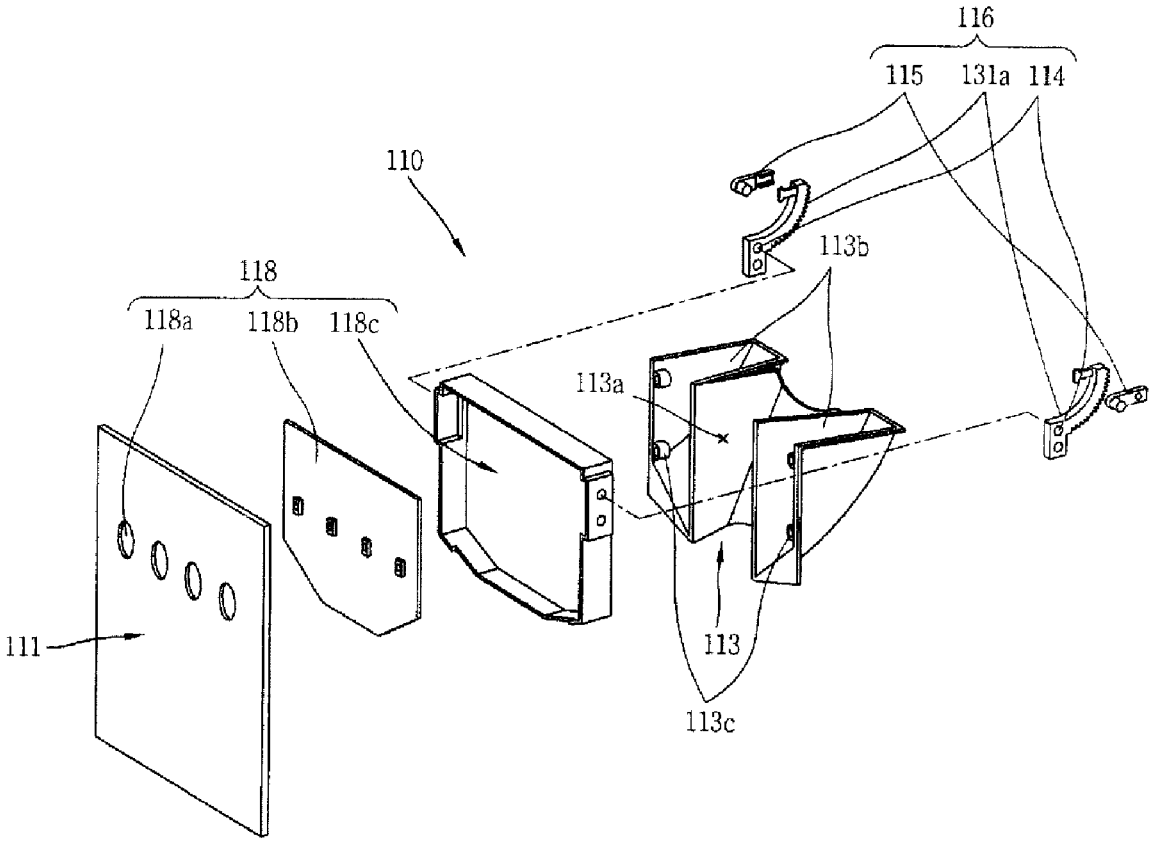
FIG. 6 is an exploded view of a cover unit and a guide unit.

FIG. 6 illustrates the cover unit 111 and the guide unit 113.

As shown in FIG. 6, in some implementations, the guide unit 113 guides ice or the like transferred via the transfer unit 140 to be dispensed to the exterior, and the cover unit 111 is attached to the front surface of the guide unit 113 to shield the opening of the dispenser receiving part 101.

Both ends of an upper portion of one of the cover unit 111 and the guide unit 113 are connected by hinges with both sides of the inner surface of the dispenser receiving part 101 so as to be rotatable in a vertical direction (up and down).

In detail, the cover unit 111 and the guide unit 113 are rotated upwardly to move to a dispensing position at which the cover unit 111 and the guide unit 113 are ejected forwardly from the door 13, and are rotated downwardly to move to a received position (closed configuration) at which the cover unit 111 and the guide unit 113 are received in the dispenser receiving part 101.

At the dispensing position, the guide unit 113 is connected with an end of the transfer unit 140 to guide ice or the like transferred via the transfer unit 140 so as to be dispensed to outside.

As shown in FIG. 3, the guide unit 113 is positioned to overlap with the transfer unit 140 at the received position. Accordingly, a space taken by the guide unit 113 at the received position may be reduced.

In addition, the cover unit 111 is provided to shield the opened front side of the dispenser receiving part 101 when at the received position.

In some implementations, the opened front of the dispenser receiving part 101 may have a particular height (h2), which is measured from the upper end of the cover unit 111 to the lower end of the dispensing button unit 120 provided under the guide unit 113, such that the dispensing button unit 120 may be pressed (or pushed).

Accordingly, a dispenser receiving unit 101 may be used as a separate additional element that provides shielding (e.g., blocking, covering, etc.) between the bottom end of the transfer unit 140 and the upper portion of the cover unit 111 (h1).

Preferably, a hinge connecting portion 115 to which the cover unit 111 or the guide unit 113 is coupled is positioned to be higher by a certain length than the upper end of the cover unit 111.

Accordingly, the rotation radius of the guide unit 113 may be increased without extending the height of the cover unit 111, and thus, the protruding length of the end of the guide unit 113 may be increased at the dispensing position.

Thus, the user may take out ice or water using the dispenser 100. In addition, because a rotation angle of the cover unit 111 and the guide unit 113 is reduced, the dispensing unit does not need to be excessively rotated to degrade an aesthetic external appearance in the dispensing operation.

In some examples, in order to reduce detrimental effects of the aesthetic external appearance at the dispensing position, the angle ($\alpha$) between the cover unit 111 and the front surface of the door 13 is maintained within the range of about 45° to 60°.

The cover unit 111 may be positioned on the same plane (level) as the surface of the door 13 at the received position.

A control button unit 11 8 for controlling the operation of the dispenser 100 may be provided between the cover unit 111 and the guide unit 113. The control button unit 118 includes a button PCB (Printed Circuit Board) 118*b* that generates a control signal when pressed by the user, a button receiving unit 118*a* positioned at the cover unit 111 and configured to transfer a pressing force to the button PCB 118*b*, and a PCB receiving unit 118*c* in which the button PCB 118*b* is received and fixed.

The control button unit 118 is attached to a rear surface of the cover unit 111 and the guide unit 113 is attached to a rear surface of the control button unit 118.

The guide unit 113 includes a guide 113*a* configured to be attached to the rear surface of the control button unit 118 to define a movement path to guide dispensed ice or the like and guide fixing units 113*b* provided at both sides of the guide 113*a* and having fastening units 113*c* configured to attach to the control button unit 118.

One end of a hinge connecting member 116, which is connected with the dispenser receiving part 101 is fixed to both ends of the rear surface of the cover unit 111, the both side surfaces of the control button unit 118, or the side surface of the guide fixing unit 113*b*. The other end of the hinge connecting member 116 is coupled with the dispenser receiving part 101.

The hinge connecting member 116 is rotated upon receiving power from the driving unit 130. The hinge connecting member 116 will be described in more detail below.

Figure 7:
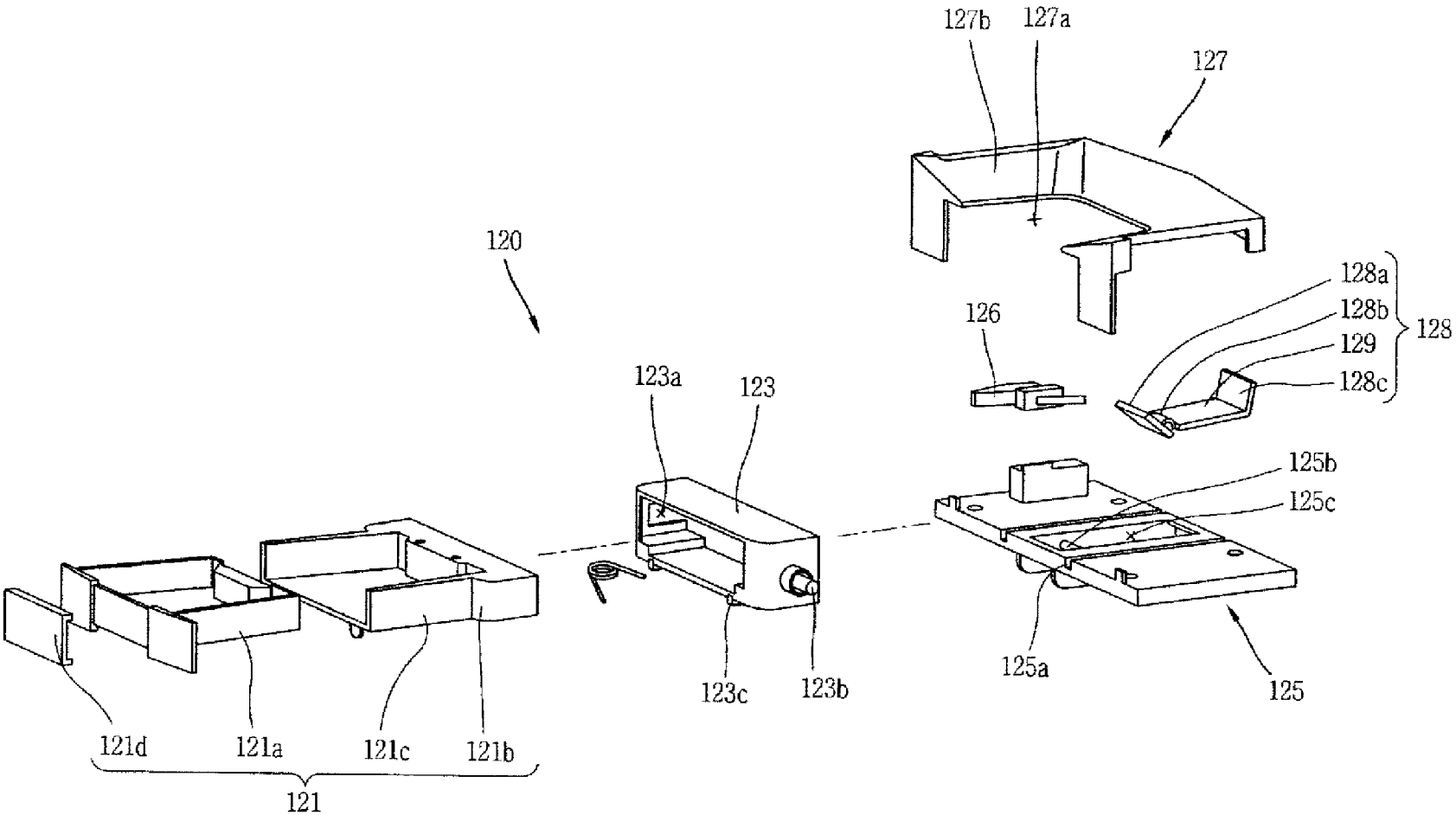
FIG. 7 is an exploded perspective view of a dispensing button unit.

FIG. 7 illustrates the dispensing button unit.

As shown in FIG. 7, in some implementations, the dispensing button unit 120 includes a button frame unit 123 that horizontally moves in or out of the dispenser receiving part 101 by cooperatively operating with a movement of the cover unit 111 or the guide unit 113 by the driving unit 130 and a button unit 121 elastically supported by the button frame unit 123 and initiating a dispensing operation.

The dispensing button unit 120 is positioned below the guide unit 113. Thus, when the button unit 121 is pressed or pushed in by using a container (or cup) being held by a user, the lip (or opening) of the container (or cup) may be aligned with a bottom edge of the guide unit 113.

The dispensing button unit 120 may further include a frame movement guide unit 125 that guides a horizontal movement of the button frame unit 123 and reduces lateral movement of the button frame unit 123.

The button unit 121 is supported by the button frame unit 123 in an elastic manner due to a restoring force that is biased in a forward direction with respect to the dispenser receiving part 101.

Thus, in order to limit movement of the button unit 121 forwardly of the dispenser receiving part 101 by the restoring force, a stop end 121*b* is positioned at a rear end of the side of the button unit 121 and a button unit stop recess 123*a* is positioned at the side of the button frame unit 123 such that it corresponds to the stop end 121*b*.

The stop end 121*b* and the button unit stop recess 123*a* may be installed on any portion of the upper or lower surfaces without being limited to the side.

A switching member 126 is installed on a movement path along which the rear end of the side of the button unit 121 moves, and pressed by the movement of the button unit 121 to generate an operation signal of the dispenser 100.

In this case, the switching member 126 may be fixedly provided on an inner side of the dispenser receiving part 101.

Alternatively, the switching member 126 may be fixed to the frame movement guide unit 125. In this example, the lateral movement of the button frame unit 123 may be reduced by the frame movement guide unit 125, thereby enhancing contact reliability between the button unit 121 and the switching member 126.

The frame movement guide unit 125 is positioned on a lower surface of the button frame unit 123 and fixed to a lower surface of an inner side of the dispenser receiving part 101. On the contact surfaces of the frame movement guide unit 125 and the button frame unit 123, a button guiding protrusion 123*c* and a button guiding groove 125*a* are provided in a corresponding manner in the movement direction of the button frame unit 123.

The button frame unit 123 allows the button unit 121 to be inserted and elastically supported therein, and a sliding protrusion 123*b* is positioned at an outer side of the button frame unit 123 and coupled with the driving unit 130 to drive the horizontal movement of the button frame unit 123.

The button unit 121 further includes a residual ice (or water) receiving unit 121*a* that is depressed from an upper surface of the button unit 121 toward the lower surface thereof and that is separably movable. The button unit 121 includes a button body 121*c* to which the residual ice receiving unit 121*a* is detachably mounted.

The dispensing button unit 120 further includes a residual ice guide unit 127 that is positioned at an upper side of the dispensing button unit 120 and guides ice or the like which is abnormally dispensed from the guide unit 113 to the residual ice receiving unit 121*a*.

For example, the residual ice guide unit 127 includes an opening 127*a* to allow ice to be transferred at an inner side thereof and a slope portion 127*b* configured to be downwardly sloped at the circumference of the opening 127*a* to guide ice dispensed to the opening 127*a*.

In some implementations, the opening 127*a* of the residual ice guide unit 127 is fixed at a certain position of an upper portion of the dispensing button unit 120 such that it corresponds to the residual ice receiving unit 121*a* when the button unit 121 is pressed.

Accordingly, if the residual ice receiving unit 121*a* is filled with much residual ice (or water), the user may release the residual ice receiving unit 121*a* to remove the internal residual ice (or water).

In some examples, a container contact unit 121*d* may be provided as an elastic member on the front surface of the residual ice receiving unit 121*a*, namely, on the face where the container for receiving ice, water, or the like contacts in order to reduce the amount of impact transferred to the container by the restoring force applied to the button unit 121 when the button unit 121 is pressed.

Also, the button unit 121 may have a maximum pressed position that is determined by a button movement restricting unit 128 positioned to face the rear surface of the button unit 121 according to the movement of the button frame unit 123.

Accordingly, upon pressing (or pushing) the button unit 121 to dispense ice, water, or the like, the user can realize that the button unit 121 has been pressed to its maximum position (by virtue of the container contact unit 121*d*).

Ice or the like dispensed through the guide unit 113 as the button unit 121 is pressed may be received in the container, and in this case, if the maximum pressed position of the button unit 121 is not restricted, the ice or the like may not be retrieved in the container and may spill.

Thus, the button movement restricting unit 128 may allow a stable dispensing operation that removes such problem.

The button movement restricting unit 128 includes a hinge portion 129 coupled in a horizontal direction at a lower portion of the dispensing button unit 120, first and second extending portions 128*a* and 128*b* that extend to the front or rear sides of the dispensing button unit 120 upwardly with respect to a horizontal surface from the hinge portion 129, and a third extending portion 128*c* that is angled from an end of the second extending portion 128*b* and positioned to face the rear surface of the button unit 121 at the dispensing position.

An installation recess 125*c*, in which the button movement restricting unit 128 is installed, may be provided at the button frame guide unit 113 in a corresponding manner, and a coupling hinge unit 125*b* may be horizontally provided in the installation recess 125*c*.

Figure 8:
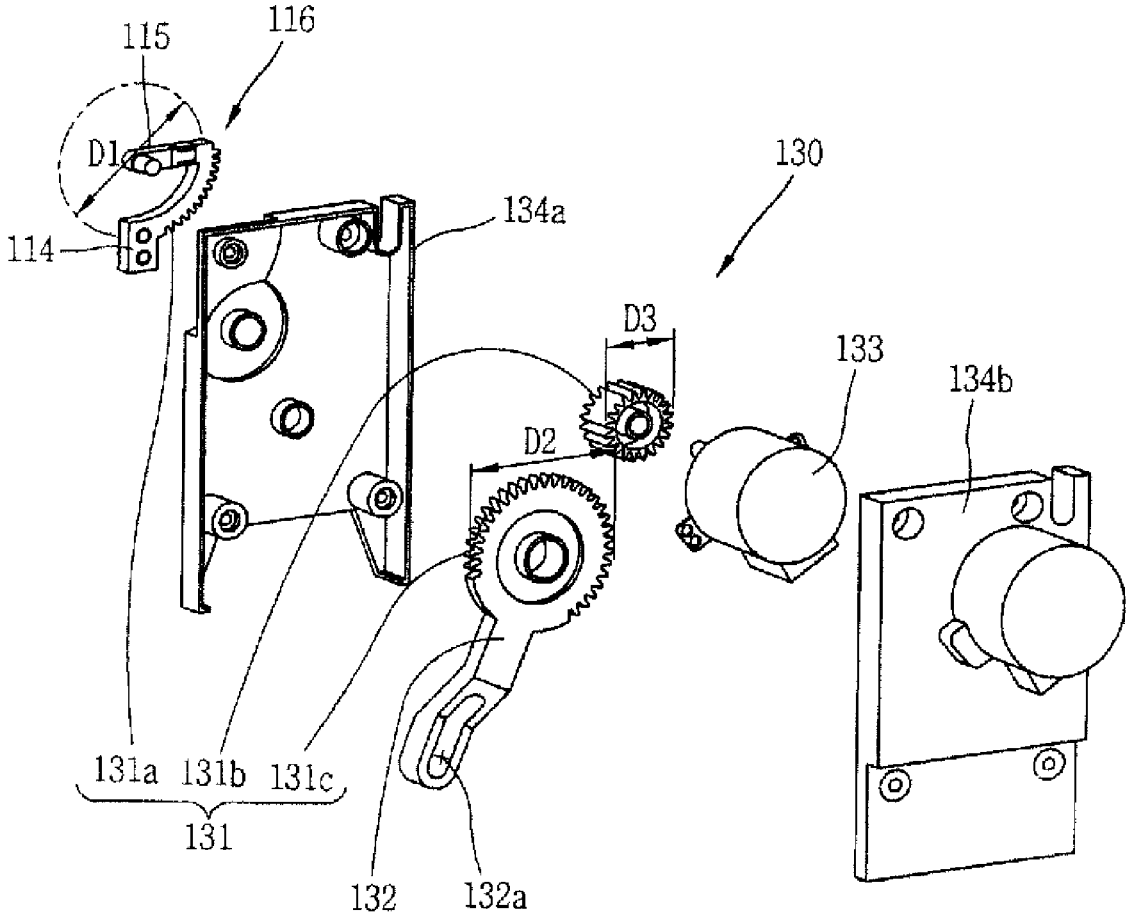
FIG. 8 is an exploded perspective view of a driving unit.
Figure 9:
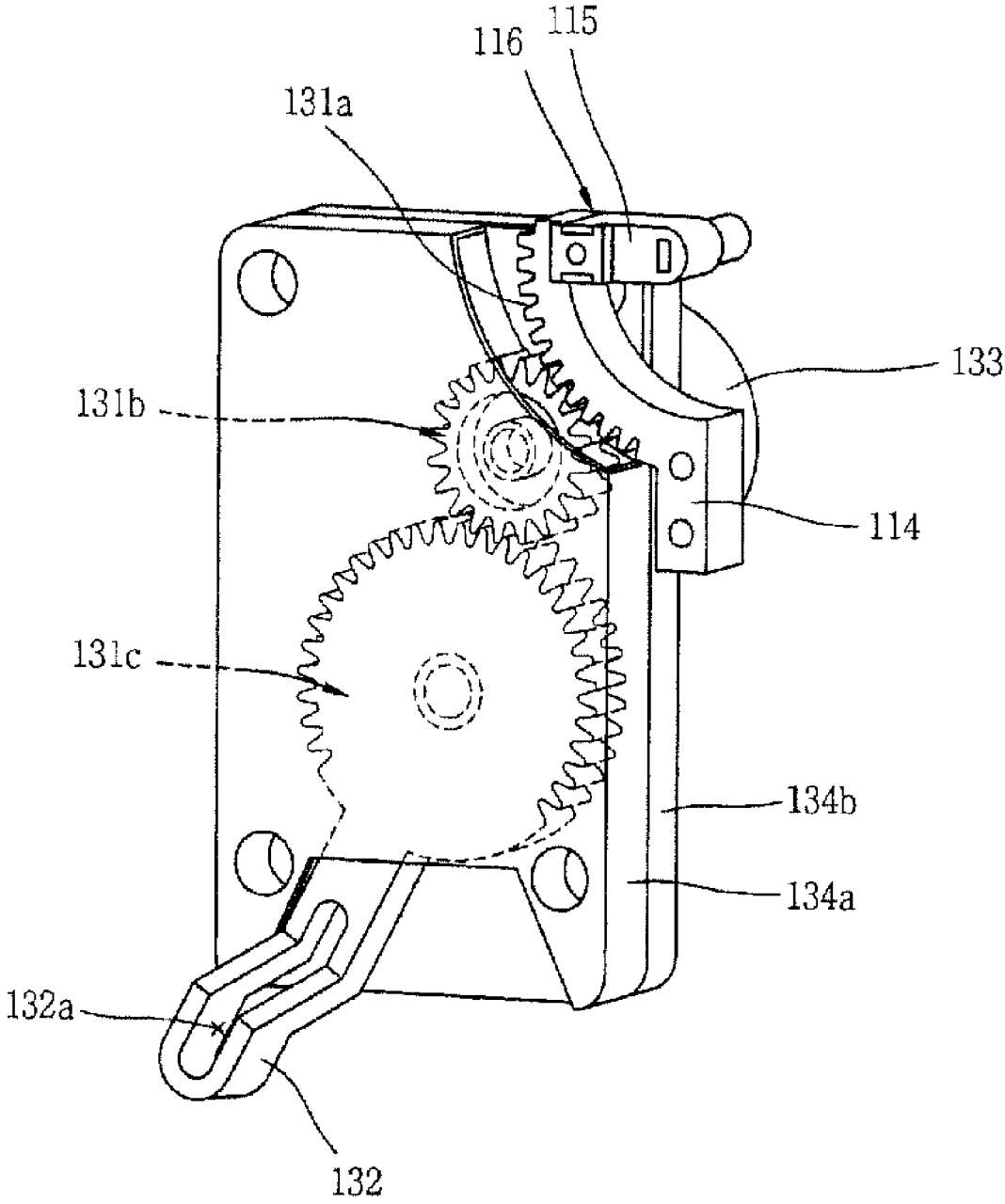
FIG. 9 is a perspective view of an assembled state of the driving unit in FIG. 8.

FIG. 8 illustrates a driving unit, and FIG. 9 shows an assembled state of the driving unit in FIG. 8.

With reference to FIGS. 8 and 9, in some implementations, the driving unit 130 includes a gear unit 131 having a plurality of gears connected with the cover unit 111 or the guide unit 113 and the dispensing button unit 120 and a motor 133 for transferring power to the gear unit 131.

The movement of the cover unit 111 or the guide unit 113 and that of the dispensing button unit 120 correspond with each other according to the rotation of the motor 133.

The gear unit 131 includes a driving gear 131*b* that is coupled with the motor 133 such that the driving gear 131*b* rotates in response to force applied by the motor 133, a first following gear 131*a* that is coupled with the driving gear 131*b* to rotate the cover unit 111 or the guide unit 113, and a second following gear 131*c* that is coupled with the driving gear 131*b* to move the dispensing button unit 120.

Here, the driving gear 131*b*, the first following gear 131*a*, and the second following gear 131*c* may be installed such that their rotation surfaces are perpendicular to the cover unit 111 (as can be seen from the Figures).

In some examples, a diameter D1 of the first following gear 131*a* is smaller than a diameter D2 of the second following gear 131*c*. In these examples, the angular velocity of the first following gear 131*a* is larger than that of the second following gear 131*c* according to the rotation of the driving gear 131*b*, so there is a difference between an ejecting speed of the cover unit 111 or the guide unit 113 and that of the dispensing button unit 120. This arrangement may reduce a problem of the movement of the dispensing button unit 120 being interfered with by the cover unit 111.

In addition, the diameter D3 of the driving gear 131*b* may be smaller than the diameters D1 and D2 of the first following gear 131*a* and the second following gear 131*c*.

The driving gear 131*b* is rotated by the motor 133 and enabling the rotation of the driving gear 131*b* to be maintained at a relatively low speed may allow for the cover unit 111 or the guide unit 113 and the dispensing button unit 120 to be smoothly ejected or retracted with minimal noise. The use of a motor having a low rotation speed, however, may be costly and complicated.

Thus, by allowing the driving gear 131*b* to have a smaller diameter, the ejecting speed of the cover unit 111 or the guide unit 113 and the dispensing button unit 120 may be reduced by using a rotation speed ratio.

The driving gear 131*b*, the second following gear 131*c* and the motor 133 are positioned within the first and second cover units 134*a* and 134*b* which are matched to connect with each other, and a portion of the driving gear 131*b* is exposed through one portion of the first cover unit 134*a*, where the first following gear 131*a* is engaged.

The first following gear 131*a* is connected with the hinge connecting portion 115 and a fixing portion 114 to constitute the hinge connecting member 116. The hinge connecting member 116 has a circular arc shape with a certain central angle. One end of the first following gear 131*a* is connected with the hinge connecting portion 115, which is connected with the dispenser receiving part 101, and the other end thereof is connected with the fixing portion 114 fixed to the cover unit 111 or the guide unit 113.

The certain central angle may be larger than the angle ($\alpha$) at which the cover unit 111 moves.

The fan-shaped internal space defined by connection of the hinge connecting potion 115 and the first following gear 131*a* serves to prevent an upper end of the cover unit 111 from being interfered with by a lower end of a front portion 101*a* of the dispenser receiving part 101 when the cover unit 111 is rotatably ejected.

The first following gear 131*a*, which is provided at one side portion (among the two side portions of the cover unit 111 or the guide unit 113) that is not connected with the driving gear 131*b*, is supported by an idle gear provided at a side portion of the dispenser receiving part 101 and rotates in a corresponding manner with the first following gear 131*a*.

The second following gear 131*c* includes a sliding lever portion 132 extending in a radius direction and driving a horizontal movement of the button frame unit 123.

The sliding lever portion 132 includes a sliding slot 132*a* in a lengthwise direction, and a sliding protrusion 123*b* extending from the side of the button frame unit 123 is inserted into the sliding slot 132*a*.

Accordingly, the sliding lever portion 132 pushes the sliding protrusion according to the rotation of the second following gear 131*c*, and in response to rotation of the second following gear 131*c*, the sliding protrusion 123*b* is horizontally moved along the sliding slot 132*a*.

Figure 10:
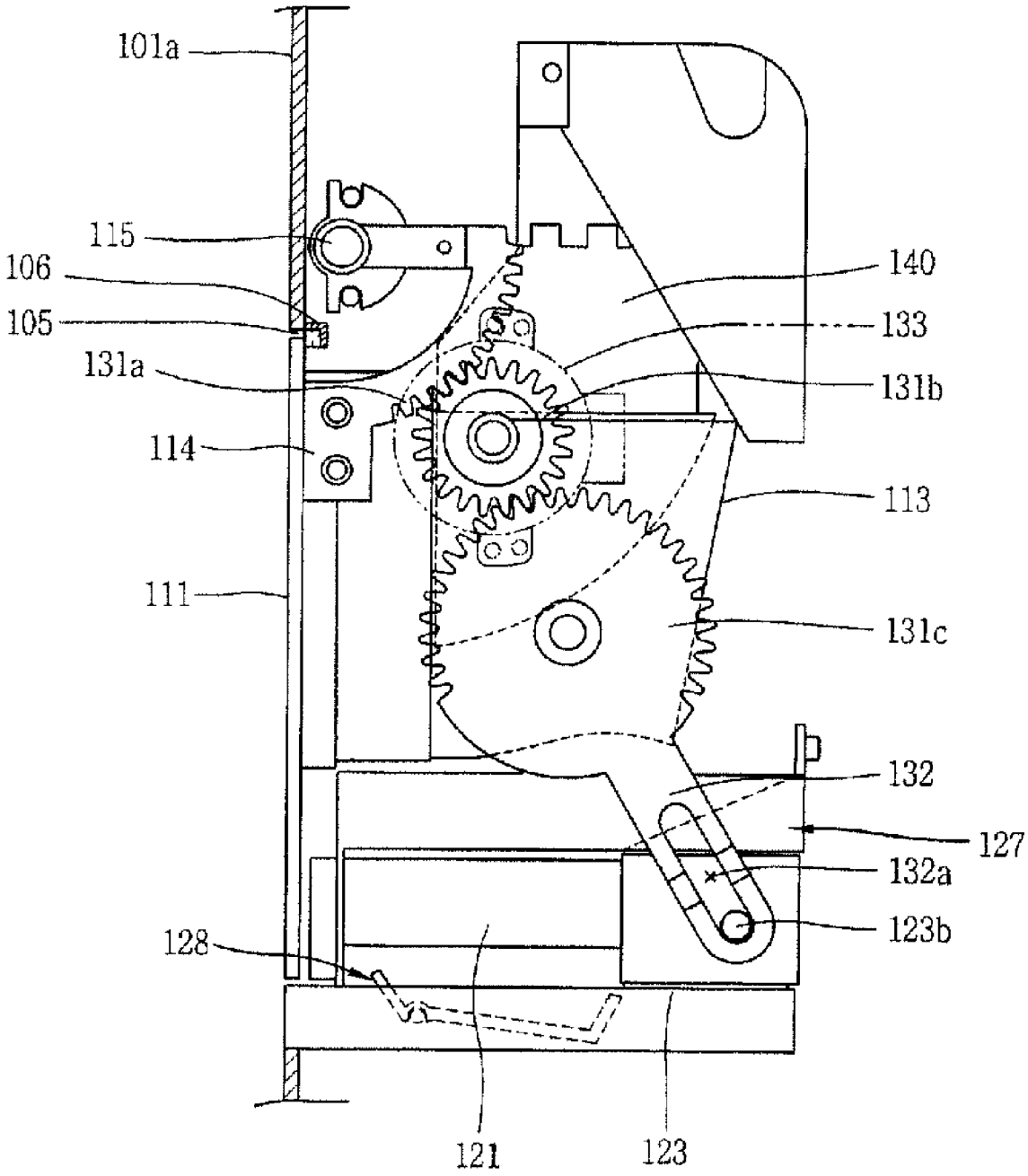
FIG. 10 is a side view of the driving unit of the dispenser at a received position.
Figure 11:
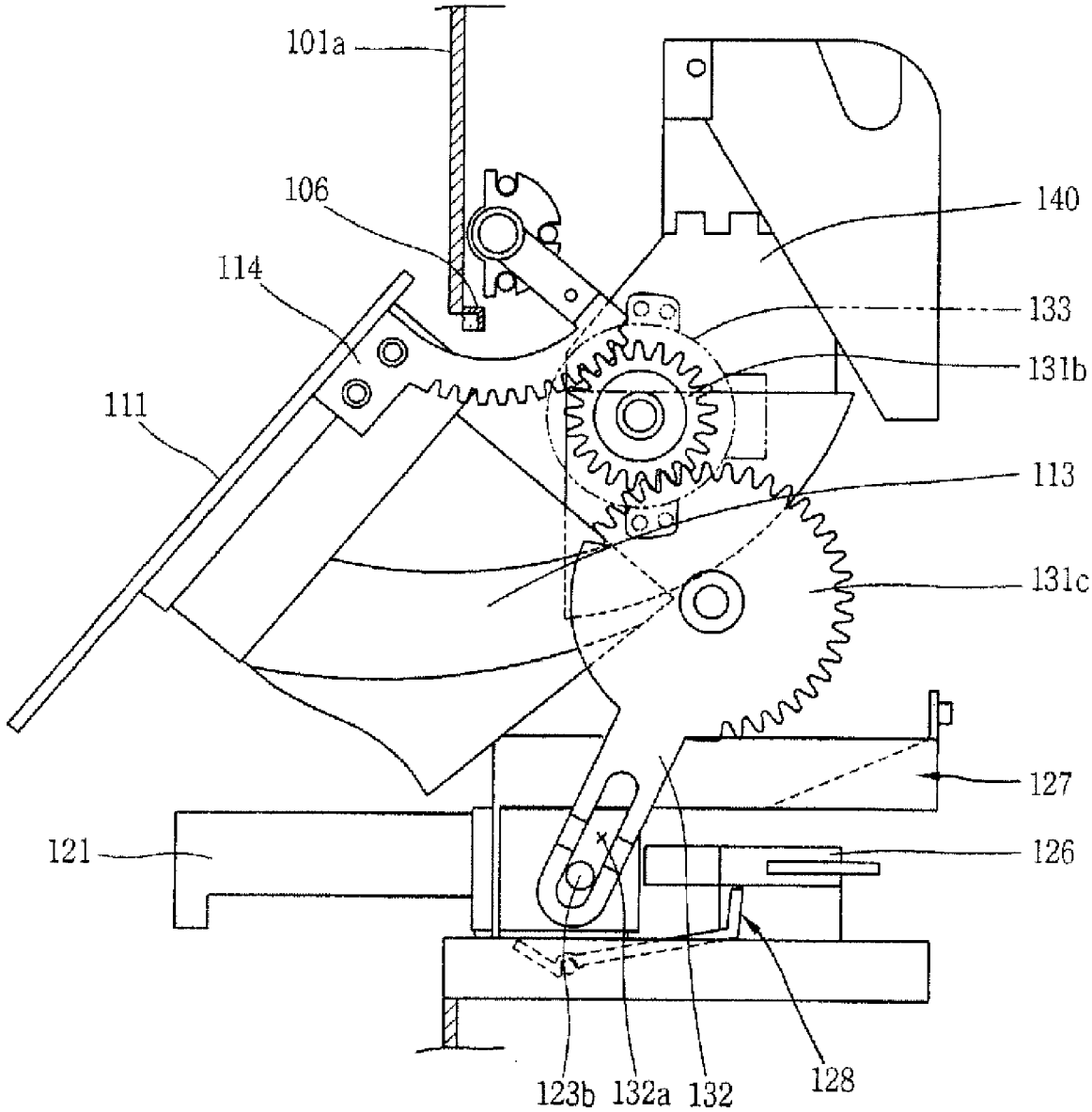
FIG. 11 is a side view of the driving unit of dispenser at a dispensing position.

FIG. 10 shows a received position of the dispenser, and FIG. 11 shows a dispensing position of the dispenser.

As shown in FIGS. 10 and 11, according to some implementations, the dispenser 100 is shielded by the cover unit 111 at the received position of the door 13 when viewed from an outer side of the refrigerator 10. As such, when the dispenser is not in use, the dispensing unit and the dispensing button unit are received at the inner side of the door and shielded by the cover unit, so that contamination, by dust, etc., of the dispensing unit and the dispensing button unit may be reduced (e.g., prevented). Moreover, when the dispenser is not in use, the cover unit is positioned on the same plane as the front surface of the door, shielding the interior, so that the external appearance of the refrigerator may be aesthetically improved.

Namely, the dispensing unit 103 is mostly shielded by the cover unit 111, and the portion of the dispensing unit 103 exposed through the gap 105 between the upper end of the opening of the dispenser receiving part 101 and the upper end of the cover unit 111 is shielded by the shielding unit 106.

As shown in FIG. 10, when the dispenser is in the received position, the guide unit 113 is positioned to overlap with the transfer unit 140, and the dispensing button unit 120 is received to the inner side of the dispenser receiving part 101 by the sliding lever portion 132.

In the received position, when an input signal of the user is transferred via the control button unit 118 provided at the cover unit 111, the driving gear 131*b* is rotated counterclockwise based on the illustration in FIG. 10 by the motor 133 and the first following gear 131*a* and the second following gear 131*c*, which are coupled with the driving gear 131, are rotated clockwise, respectively.

Accordingly, the cover unit 111 and the guide unit 113 are rotated based on the hinge connecting portion 115 as a central shaft and thereby ejected from the dispenser receiving part 101.

Also, the sliding protrusion 123*b* positioned at the button frame unit 123 is horizontally moved, along the sliding slot 132*a* formed at the sliding lever unit 132, to the front side of the dispenser receiving part 101.

Thereafter, when the button unit 121 is pressed by the user, the switching member 126 positioned on the movement path of the button unit 121 is pressed by the button unit 121 to generate an ice dispense signal, a water dispense signal, or the like.

Accordingly, ice, water, or the like is transferred through the transfer unit 140 and dispensed externally through the guide unit 113.

The movement from the dispensing position (opened configuration) to the received position (closed configuration) is the opposite to that of the dispensing operation described above.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator having a dispenser, comprising a cooling compartment;

a door configured to open and close at least a portion of the cooling compartment;

a dispensing unit that is configured to move between a received position at which a dispenser outlet of the dispensing unit is positioned on a side of a surface of the door where the cooling compartment is positioned and a dispensing position at which the dispenser outlet of the dispensing unit is positioned on a side of the surface of the door opposite of the cooling compartment;

a dispenser receiving structure that defines, within the door, a receiving space in which the dispenser outlet is positioned when the dispensing unit is oriented in the received position and that defines, in the surface of the door, an opening through which the dispenser outlet of the dispensing unit passes when the dispensing unit moves from the dispensing position to the received position;

a cover unit that is attached to the dispensing unit and moves with the dispensing unit, the cover unit and the dispensing unit being coupled to enable a portion of the opening defined in the surface of the door by the dispenser receiving structure to be covered by the cover unit when the dispensing unit is oriented in the received position, and to enable a gap to remain on the surface of the door between the cover unit and the dispenser receiving structure when the dispensing unit is oriented in the received position; and a shielding unit configured to cover the gap remaining between the dispenser receiving structure and the cover unit when the dispensing unit is oriented in the received position.

2. The refrigerator of claim 1, wherein the cover unit is configured to rotate about an axis of rotation that is above the cover unit when the refrigerator is oriented in a normal operating orientation.

3. The refrigerator of claim 2, wherein the cover unit is configured to rotate, about the axis of rotation that is above the cover unit, from the surface of the door without any part of the cover unit rotating into the space defined by the dispenser receiving structure.

4. The refrigerator of claim 2, wherein the cover unit is configured to rotate, about the axis of rotation that is above the cover unit, from the surface of the door without any part of the cover unit passing through the opening defined in the surface of the door by the dispenser receiving structure.

5. The refrigerator of claim 2, wherein the cover unit is configured to rotate, about the axis of rotation that is above the cover unit, from the surface of the door while maintaining a consistent separation distance between an edge of the cover unit and an edge of the dispenser receiving structure that defines the opening in the surface of the door.

6. The refrigerator of claim 1 wherein the gap covered by the shielding unit is a portion of the opening not covered by the cover unit when the dispensing unit is oriented in the received position and the cover unit covers the portion of the opening defined in the surface of the door by the dispenser receiving structure.

7. The refrigerator of claim 1, wherein the cover unit is positioned in a plane of the surface of the door when the dispensing unit is oriented in the received position.

8. The refrigerator of claim 1, wherein the shielding unit is positioned, in the space defined by the dispenser receiving structure, around a portion of a surface perimeter of the dispenser receiving structure that defines the opening, with the shielding unit overlapping a portion of an outer perimeter of the cover unit when the dispensing unit is oriented in the received position.

9. The refrigerator of claim 8, further comprising a hermetically sealing member that is made of an elastic material, that overlaps with the cover unit when the dispensing unit is oriented in the received position, and that is attached to one of the shielding unit and the cover unit.

10. The refrigerator of claim 8, wherein the shielding unit is positioned around an entire perimeter of the dispenser receiving structure that defines the opening, with the shielding unit overlapping with an entire outer perimeter of the cover unit when the dispensing unit is oriented in the received position and the opening is completely covered by the cover unit and the shielding unit.

11. The refrigerator of claim 1, wherein the dispensing unit comprises:

a guide unit that is attached to a surface of the cover unit positioned closest to the cooling compartment, that defines the dispenser outlet, and that is configured to guide ice through the dispenser outlet when the dispensing unit is oriented in the dispensing position;

a dispensing button unit that is configured to move, along with the cover unit, between a stored position at which the dispensing button unit is positioned on the side of the surface of the door where the cooling compartment is positioned and an extended position at which at least a portion of the dispensing button unit is positioned on the side of the surface of the door opposite of the cooling compartment, the dispensing button unit being configured to, in the extended position, control dispensing of content through the dispenser outlet in response to manipulation of the dispensing button unit; and a driving unit that is configured to move the dispensing unit from the received position to the dispensing position in response to user input and that is configured to move the dispensing button unit from the stored position to the extended position in response to user input.

12. The refrigerator of claim 11, wherein the dispensing button unit comprises:

a button frame unit that is positioned below the guide unit when the refrigerator is oriented in a normal operating orientation and that is configured to move between the stored position at which the button frame unit is positioned on the side of the surface of the door where the cooling compartment is positioned and the extended position at which at least a portion of the button frame unit is positioned on the side of the surface of the door opposite of the cooling compartment; and a button unit that is elastically supported by the button frame unit and that is configured to, when the button frame unit is oriented in the extended position, move, in response to application of force to the button unit, toward the surface of the door from a first position to a second position that is closer to the surface of the door than the first position and move, in response to release of the force applied to the button unit, away from the surface of the door from the second position to the first position, the button unit being configured to cause the dispensing unit to dispense content through the dispenser outlet when the button unit is moved to the second position.

13. The refrigerator of claim 11, wherein the driving unit comprises:

a driving gear configured to be driven by a motor;

a first following gear engaged with the driving gear and configured to rotate the dispensing unit from the received position to the dispensing position in response to the driving gear being driven by the motor; and a second following gear engaged with the driving gear and configured to move the dispensing button unit from the stored position to the extended position in response to the driving gear being driven by the motor.

14. The refrigerator of claim 13, wherein the first following gear has circular arc shape with a central angle of less than 360 degrees being defined between radial axes extending from a rotation axis of the arc and endpoints of the first following gear periphery, a first end of the first following gear is connected at the rotation axis, a second end of the first following gear is connected with the dispensing unit, and the first following gear is configured to rotate about the rotation axis in response to the driving gear being driven by the motor.

15. The refrigerator of claim 13, wherein the second following gear comprises a sliding unit that extends in a radial direction and comprises a sliding slot configured to receive a sliding protrusion positioned at a side of the dispensing button unit, the sliding unit being configured to move the dispensing button unit by applying force to the sliding protrusion when the sliding protrusion is received in the sliding slot.

16. A refrigerator, comprising a cooling compartment;

a door configured to open and close at least a portion of the cooling compartment;

a dispensing unit that is configured to move between a received position at which a dispenser outlet of the dispensing unit is positioned on a side of a surface of the door where the cooling compartment is positioned and a dispensing position at which the dispenser outlet of the dispensing unit is positioned on a side of the surface of the door opposite of the cooling compartment;

a dispenser receiving structure that defines, within the door, a receiving space in which the dispenser outlet is positioned when the dispensing unit is oriented in the received position and that defines, in the surface of the door, an opening through which the dispenser outlet of the dispensing unit passes when the dispensing unit moves from the dispensing position to the received position;

a cover unit that is attached to the dispensing unit and moves with the dispensing unit, the cover unit being configured to cover a portion of the opening defined in the surface of the door by the dispenser receiving structure when the dispensing unit is oriented in the received position; and means for covering a gap between the dispenser receiving structure and the cover unit when the dispensing unit is oriented in the received position and the cover unit covers the portion of the opening defined in the surface of the door by the dispenser receiving structure.

17. A refrigerator, comprising a cooling compartment;

a door configured to open and close at least a portion of the cooling compartment;

a dispensing unit that is configured to move between a received position at which a dispenser outlet of the dispensing unit is positioned on a side of a surface of the door where the cooling compartment is positioned and a dispensing position at which the dispenser outlet of the dispensing unit is positioned on a side of the surface of the door opposite of the cooling compartment;

a dispenser receiving structure that defines, within the door, a receiving space in which the dispenser outlet is positioned when the dispensing unit is oriented in the received position and that defines, in the surface of the door, an opening through which the dispenser outlet of the dispensing unit passes when the dispensing unit moves from the dispensing position to the received position; and a cover unit that is attached to the dispensing unit and that moves with the dispensing unit, the cover unit being configured to cover a portion of the opening defined in the surface of the door by the dispenser receiving structure when the dispensing unit is oriented in the received position; and a hinge defining an axis of rotation that is above the cover unit when the refrigerator is oriented in a normal operating orientation.

18. The refrigerator of claim 17, wherein the cover unit is configured to rotate, about the axis of rotation that is above the cover unit, from the surface of the door without any part of the cover unit rotating into the space defined by the dispenser receiving structure.

19. The refrigerator of claim 17, wherein the cover unit is configured to rotate, about the axis of rotation that is above the cover unit, from the surface of the door without any part of the cover unit passing through the opening defined in the surface of the door by the dispenser receiving structure.

20. The refrigerator of claim 17, wherein the cover unit is configured to rotate, about the axis of rotation that is above the cover unit, from the surface of the door while maintaining a consistent separation distance between an edge of the cover unit and an edge of the dispenser receiving structure that defines the opening in the surface of the door.

* * * * *